US005714702A

United States Patent [19]

Ishii

[11] Patent Number: 5,714,702

[45] Date of Patent: Feb. 3, 1998

[54] PEDAL CONTROLLING SYSTEM AND METHOD OF CONTROLLING PEDAL FOR RECORDING AND REPRODUCING PEDAL ACTION

[75] Inventor: Jun Ishii, Shizuoka, Japan

[73] Assignee: Yamaha Corporation, Japan

[21] Appl. No.: 671,740

[22] Filed: Jun. 28, 1996

[30] Foreign Application Priority Data

Jun. 28, 1995 [JP] Japan ..... 7-162684
May 17, 1996 [JP] Japan ..... 8-123538

[51] Int. Cl.[6] ..... G10G 3/04

[52] U.S. Cl. ..... 84/462; 84/13; 84/34; 84/607; 84/621

[58] Field of Search ..... 84/13, 34, 225, 84/462, 463, 621, 607, 721, 746

[56] References Cited

U.S. PATENT DOCUMENTS 4,450,749 5/1984 Stahnke ..... 84/462
5,523,522 6/1996 Koseki et al. ..... 84/21

*Primary Examiner*—Michael L. Gellner
*Assistant Examiner*—Shih-yung Hsieh
*Attorney, Agent, or Firm*—Graham & James LLP

[57] ABSTRACT

A pedal controller monitors a damper pedal incorporated in an acoustic piano, and reduces the amount of music data information represented by digital pedal position signals through an anti-aliasing filtering, a decimation and an interpolation without sacrificing the accuracy of the pieces of music data information.

9 Claims, 17 Drawing Sheets

PEDAL CONTROLLING SYSTEM AND METHOD OF CONTROLLING PEDAL FOR RECORDING AND REPRODUCING PEDAL ACTION

FIELD OF THE INVENTION

This invention relates to a pedal controlling system exactly discriminating the position of the pedal for recording and reproducing a pedal action and, more particularly, to a pedal controlling system and a method of controlling a pedal for recording and reproducing a pedal action in a performance of a musical instrument such as an automatic player piano.

DESCRIPTION OF THE RELATED ART

An automatic player piano is a piano equipped with a key/pedal controlling system, and the key/pedal controlling system successively responds to music data codes for selectively driving the black and white keys and the pedals so as to reproduce an original performance. The key/pedal controlling system may record the original performance in a suitable memory such as a floppy disk, and the music data codes may be stored in the floppy disk by another source.

FIG. 1 illustrates the prior art pedal controller incorporated in the automatic player piano. While a pianist is performing the automatic player piano, the pianist selectively steps on the damper/soft pedals in the performance, and associated pedal sensors change analog pedal position signals PPS indicative of current pedal positions.

The analog pedal position signals PPS are supplied to the prior art pedal controller 1, and a normalization circuit 1*a* normalizes the analog pedal position signals PPS. The pianos have respective individuality, and the normalization removes the individualities from the analog pedal position signals PPS. In other words, the normalization circuit 1*a* changes the individual analog pedal position signals PPS to normalized analog pedal position signals produced by pedal sensors incorporated in a standard piano.

The normalized analog pedal position signals are supplied to a digitizer 1*b*, and the digitizer 1*b* converts the analog position signals to variable-length data codes. In detail, while a pianist is stepping on the damper pedal, the damper heads are gradually decreasing the pressure against the associated strings, and leave from the strings through half pedal state. The damper heads lightly contact with the associated strings in the half pedal state, and delicately change piano sounds. The piano sounds in the half pedal state makes the musical expression variety. In other words, the damper head passes the half pedal state through an extremely narrow range in the trajectory of the pedal, and the pedal sensor is expected to detect the pedal position with accuracy. For this reason, the digitizer 1*b* increases the bit string of the variable-length data code. However, a short bit string expresses the current pedal position outside of the narrow range, and reduces the memory area for storing the data codes.

The variable-length data codes are supplied to a hysteresis generator 1*c*, and the hysteresis generator 1*c* changes the values of the variable-length data codes so as to give a hysteresis between the variable-length data codes representative of the downward pedal motion and the variable-length data codes representative of the upward pedal motion.

The variable-length data codes are supplied from the hysteresis generator 1*c* to a floppy disk driver 1*d*, and pieces of music data information represented by the variable-length data codes are stored in a floppy disk 1*e* together with other pieces of music data information representative of key motions. The variable-length data codes and the music data codes for the key motions are representative of the original performance.

When the prior art pedal controller 1 reproduces the pedal motions in the original performance, the pieces of music data codes are read out from the floppy disk 1*e*, and the variable-length data codes and the music data codes are restored. The variable-length data codes are supplied to an interpolation circuit 1*f*, and are restored through the interpolation function. Subsequently, an inverse normalization circuit 1*g* gives the individuality to the variable-length data codes, and a driver circuit tailors driving current signals from the variable length data codes so as to move the pedals as if the player steps on the pedals again.

FIG. 2 illustrates another prior art pedal controller 2. Pedal sensors are provided for the pedals incorporated in an automatic player piano. An analog anti-aliasing filter 2*a*, an analog-to-digital converter 2*b*, a floppy disk driver 2*c*, a digital-to-analog converter 2*d* and an analog smoothing filter 2*e* are incorporated in the prior art pedal controller 2. The analog pedal position signal PPS is supplied to the analog anti-aliasing filter 2*a*, and the analog anti-aliasing filter previously eliminates aliasing noise from the analog pedal position signals PPS. The analog pedal position signals PPS are converted to digital pedal position signals by the analog-to-digital converter 2*b*, and the floppy disk driver 2*c* stores pieces of music data information represented by the digital pedal position signals in a floppy disk 2*f*.

When a playback is requested, the floppy disk driver 2*c* reads out the pieces of music data information, and restores the digital pedal position signals. The digital-to-analog converter 2*d* produces analog pedal position signals from the digital pedal position signals, and the analog pedal position signals are smoothened by means of the analog smoothing filter 2*e*.

The two prior art pedal controller 1 and 2 encounter following problems.

The first problem inherent in the first prior art pedal controller I is inaccuracy outside of the half pedal range, and the second problem is a large amount of variable-length data codes. The second problem is derived from a high sampling frequency in the digitizer 1*b*. If the sampling frequency is lowered, the variable-length data codes are strongly affected by the aliasing noise, because the analog pedal position signals are not previously subjected to the anti-aliasing filtering. The third problem is a time lug due to the hysteresis imparted to the variable-length data codes.

On the other hand, the second prior art pedal controller 2 encounter the first problem in a large amount of music data codes. The anti-aliasing filter 2*a* and the smoothing filter 2*e* are of an analog circuit, and do not achieve steep cut-off characteristics. This results in a high sampling frequency in the analog-to-digital converter 2*b*, and the analog-to-digital converter 2*b* produces a large mount of music data codes. If the sampling frequency is further decreased, the aliasing noise is not ignoreable, and the lower sampling frequency deteriorates the accuracy of the pedal position.

SUMMARY OF THE INVENTION

It is therefore an important object of the present invention to provide a pedal controlling system which samples an analog pedal position signal at a low frequency without sacrifice of the accuracy.

It is also an important object of the present invention to provide a method of controlling a pedal for recording and reproducing a pedal action through a small amount of data without an influence of aliasing noise.

To accomplish the object, the present invention proposes to eliminate noise components from pedal position signals, decimate and interpolate the pedal position signals.

In accordance with one aspect of the present invention, there is provided a pedal controller for recording and reproducing a motion of a pedal, comprising: a recording system including a pedal position monitoring means for periodically generating first pedal position signals representative of the motion at a first frequency, an noise eliminating means for eliminating frequency components due to a noise from the first pedal position signals, a decimating means for selecting second pedal position signals from the first pedal position signals, and a recording means for storing pieces of data information represented by the second pedal position signals into a recording medium; and a playback system including an interpolation means for interpolating dummy data signals into third pedal position signals restored from the pieces of data information, the dummy data signals and the third pedal position signals forming fourth pedal position signals periodically output therefrom at a second frequency larger in value than the first frequency, a smoothing means smoothing the fourth pedal position signals for generating fifth pedal position signals, and an actuator means responsive to the fifth pedal position signals for reproducing the motion of the pedal.

In accordance with another aspect of the present invention, there is provided a method of controlling a pedal, comprising the steps of: periodically generating first pedal position signals representative of a motion of the pedal at a first frequency, eliminating frequency components due to a noise from the first pedal position signals, decimating the first pedal position signals for generating second pedal position signals, recording pieces of data information represented by the second pedal position signals into a recording medium, interpolating dummy data signals into third pedal position signals restored from the pieces of data information so as to generating fourth pedal position signals at a second frequency larger in value than the first frequency, smoothing the fourth pedal position signals for generating fifth pedal position signals, and moving the pedal in response to the fifth pedal position signals for reproducing the motion.

BRIEF DESCRIPTION OF THE DRAWINGS

The features and advantages of the pedal controlling system and the method according to the present invention will be more clearly understood from the following description taken in conjunction with the accompanying drawings in which.

DESCRIPTION OF THE PREFERRED EMBODIMENTS

First Embodiment

Figure 1:
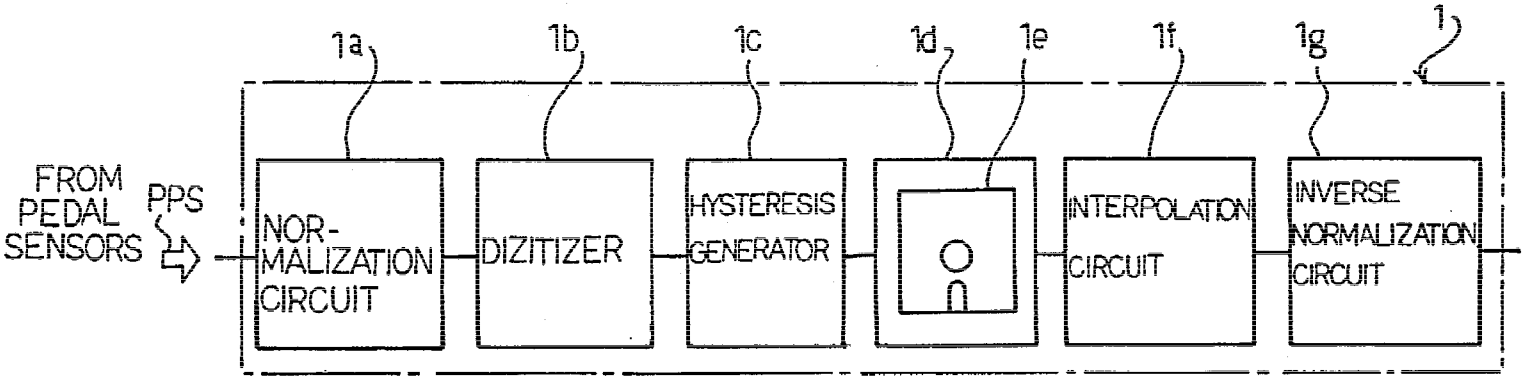
Fig.1 PRIOR ART
FIG. 1 is a block diagram showing the first prior art pedal controlling system incorporated in the automatic player piano.
Figure 2:
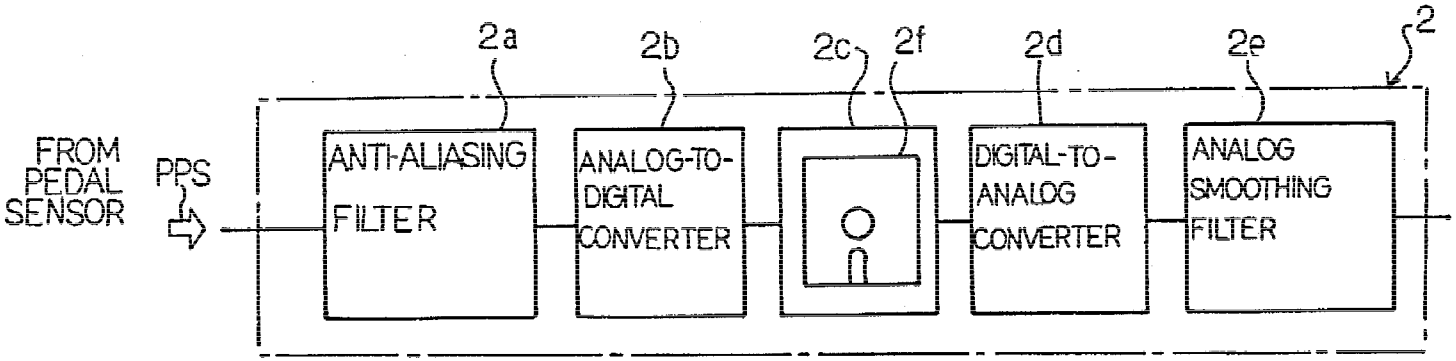
Fig.2 PRIOR ART
FIG. 2 is a block diagram showing the second prior art pedal controlling system incorporated in another automatic player piano.
Figure 3:
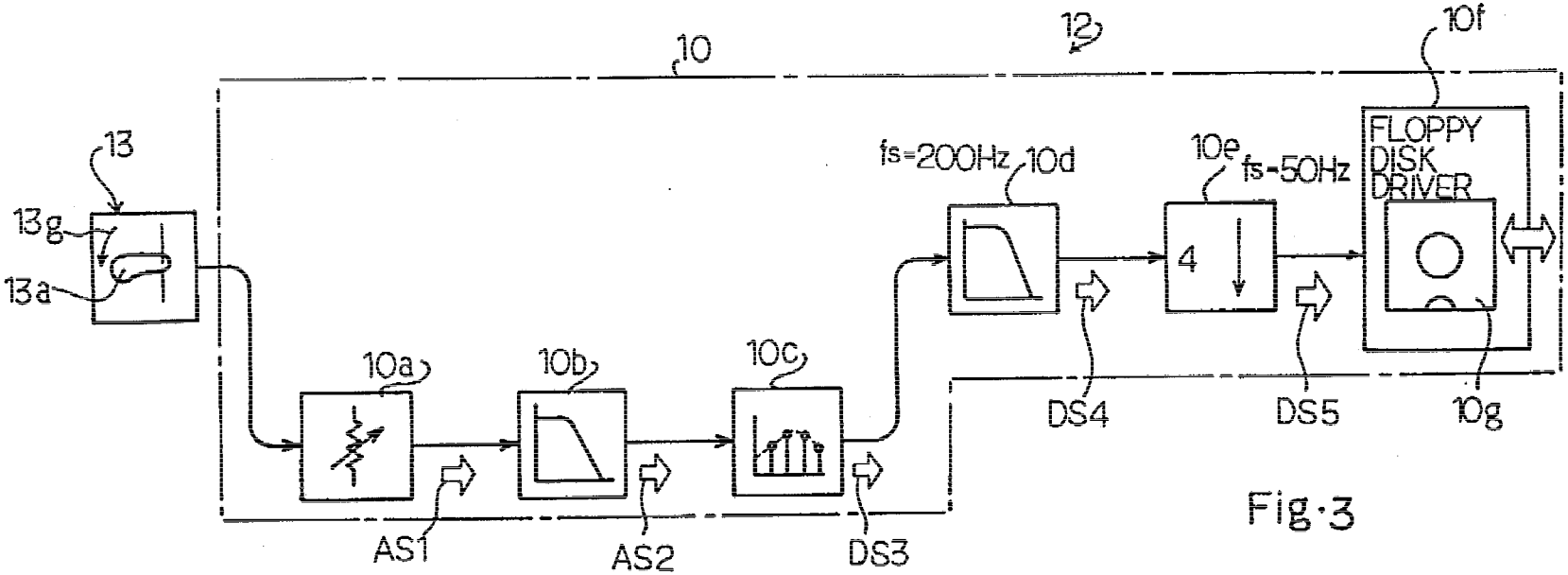
FIG. 3 is a diagram showing a recording system incorporated in a pedal controller according to the present invention together with essential signal waveforms.
Figure 4:
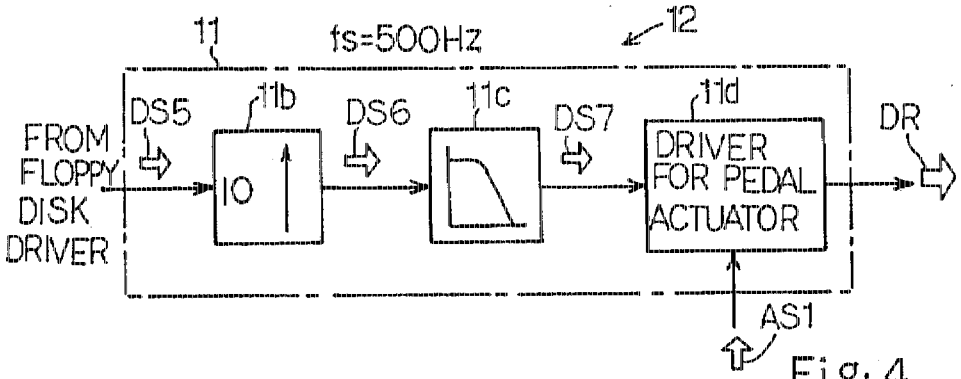
FIG. 4 is a diagram showing a playback system incorporated in the pedal controller according to the present invention together with essential signal waveforms.

Referring first to FIGS. 3 and 4 of the drawings, a recording system 10 and a playback system 11 are incorporated in a pedal controller 12, and the pedal controller 12 is associated with a damper pedal mechanism 13 of an automatic player piano.

Figure 5:
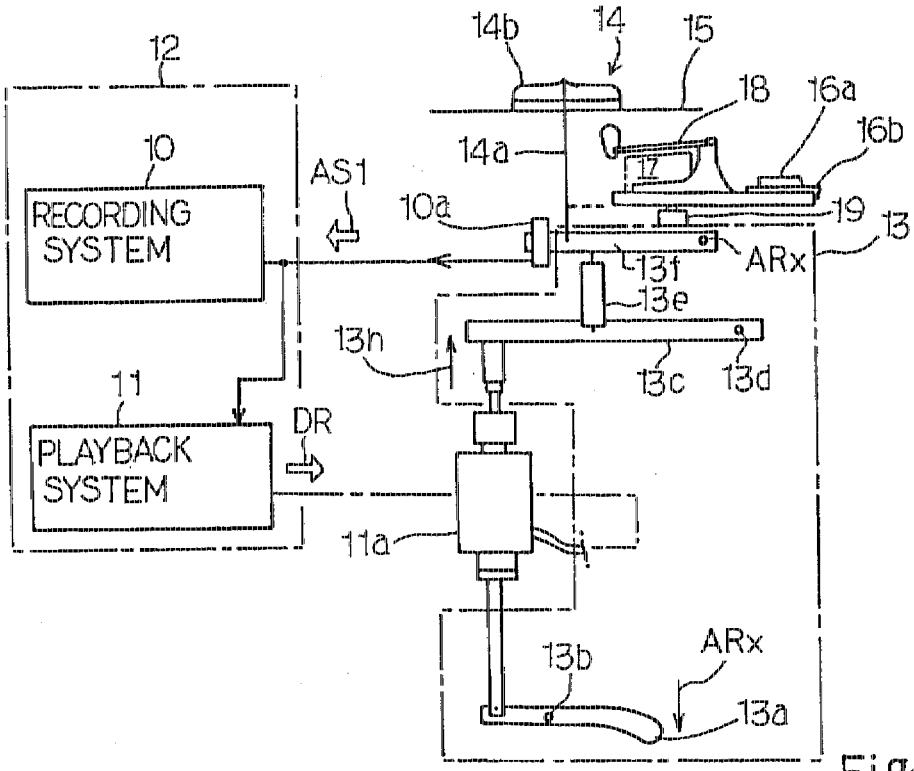
FIG. 5 is a side view showing a damper pedal mechanism incorporated in the automatic player piano.

FIG. 5 illustrates the damper pedal mechanism 13, and the damper pedal mechanism 13 includes a damper pedal 13*a* turnable around a pin 13*b*, a lever 13*c* connected through a solenoid-operated pedal actuator 11*a* to the damper pedal 13*a* and turnable around a pin 13*d*, a rod 13*e* connected to the lever 13*c* and a lifting rail 13*g* connected to the rod 13*e* and turnable around a pin 13*g*.

When a player steps on the damper pedal 13*a*, the leading end portion of the damper pedal 13*a* is downwardly moved as indicated by an arrow 13*g*, and the damper pedal 13*a* turns around the pin 13*b*. The rear end portion of the damper lever 13*a* is lifted, and the upward motion of the rear end portion is transferred through the solenoid-operated pedal actuator 11*a* to the lever 13*c* as indicated by an arrow 13*h*. The lever 13*c* turns around the pin 13*d*, and the rod 13*e* pushes up the lifting rail 13*f*.

The lifting rail 13*f* is shared between damper mechanisms 14, and pushes up all of damper levers (not shown) and, accordingly, damper wires 14*a* so as to space the damper heads 14*b* from associated strings 15.

While the lifting lever 13*f* is causing the damper heads 14*b* to space the damper heads 14*b* from the strings 15, the black and white keys 16*a*/16*b* do not bring the damper heads 14*b* into contact with the strings 15 after the release. When the player or solenoid-operated key actuators 19 selectively move the black and white keys 16*a*/16*b*, the black and white keys 16*a* and 16*b* cause key action mechanisms 17 to rotate hammer assemblies 18, and the hammer assemblies 18 strike the strings 15 for generating acoustic sounds. The black and white keys 16*a*/16*b* are released; however, the lifting rail 13*f* keeps the damper heads 14*b* spaced, and the damper heads 14*b* spaced from the strings 15 prolong the acoustic sounds.

When the player removes his foot from the damper pedal 13*a*, the lifting rail 13*f*, the rod 13*e*, the lever 13*c* and the damper pedal 13*a* are moved in the opposite direction, and the damper heads 14*b* are brought into contact with the strings 15.

The playback system 11 energizes and deenergizes the solenoid-operated pedal actuator 11*a*, and the solenoid-operated pedal actuator 11*a* moves the damper heads 14*b* as if the player manipulates the damper pedal 13*a*.

Turning back to FIG. 3, the recording system 10 includes an analog position sensor 10*a*, and the analog position sensor 10*a* monitors the motion of the lifting rail 13*f*. As described hereinbefore, the damper pedal 13*a* moves the lifting rail 13*f*, and the trajectory of the lifting lever 13*f* is similar to the trajectory of the damper pedal 13*a*. For this reason, the analog position sensor 10*a* monitors the damper pedal 13*a* through the lifting rail 13*f*, and generates an analog pedal position signal AS1 representative of current pedal position. The analog pedal position signal AS1 has a frequency spectrum labeled with "AS1" in FIG. 6.

Though not shown in the drawings, the analog position sensor 10*a* has a gray scale attached to the lifting lever 13*f* and a photo-coupler for converting light reflected from the gray scale to the analog pedal position signal AS1. The gray scale gradually changes the shade of color, and the optical intensity of the reflection is varied depending upon the relative position between the photo-coupler and the gray scale, i.e., the lifting rail 13*f*.

The recording system 10 further includes a first anti-aliasing filter 10*b* connected to the analog position sensor, and the first anti-aliasing filter 10*b* eliminates frequency components equal to or greater than 100 Hz from the analog pedal position signal AS1. In other words, the first anti-aliasing filter 10*b* has a cut-off frequency at 100 Hz. The frequency components eliminated from the analog pedal position signal are mainly due to electric noise, and the electric noise contains a noise component due to an incorrect linearity of the analog position sensor 10*a* and another noise component due to electromagnetic wave from the outside, by way of example. However, a noise due to a mechanical source is not contained in the electric noise. The filtered analog pedal position signal is labeled with "AS2", and the frequency spectrum is changed from "AS1" to "AS2" (see FIG. 6).

Figure 7:
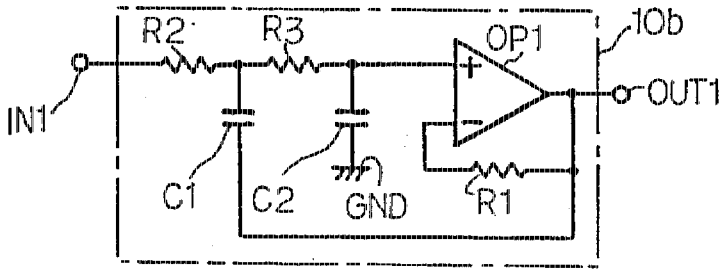
FIG. 7 is a circuit diagram showing the circuit configuration of a first anti-aliasing filter incorporated in the recording system.

The circuit configuration of the first anti-aliasing filter 10*b* is illustrated in FIG. 7, and a second-order Bessel type low pass filter serves as the first anti-aliasing filter 10*b*. The Bessel type low pass filter is constant in group delay, and, accordingly, does not cause the signal waveform to fluctuate. The Bessel type low pass filter is desirable for the first anti-aliasing filter 10*b*.

Figure 8:
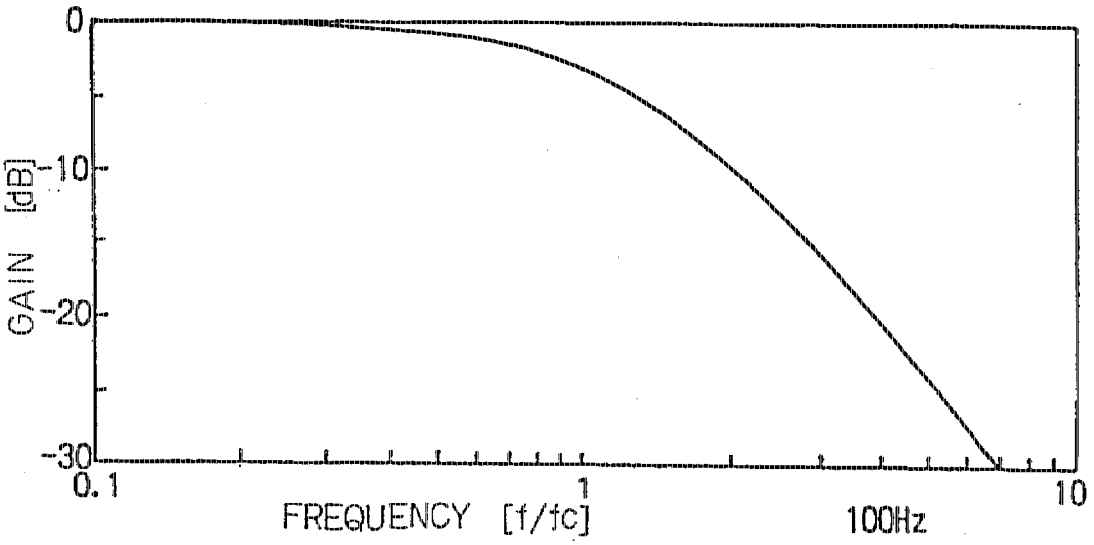
FIG. 8 is a graph showing frequency characteristics of the first anti-aliasing filter shown in FIG. 7.
Figure 9:
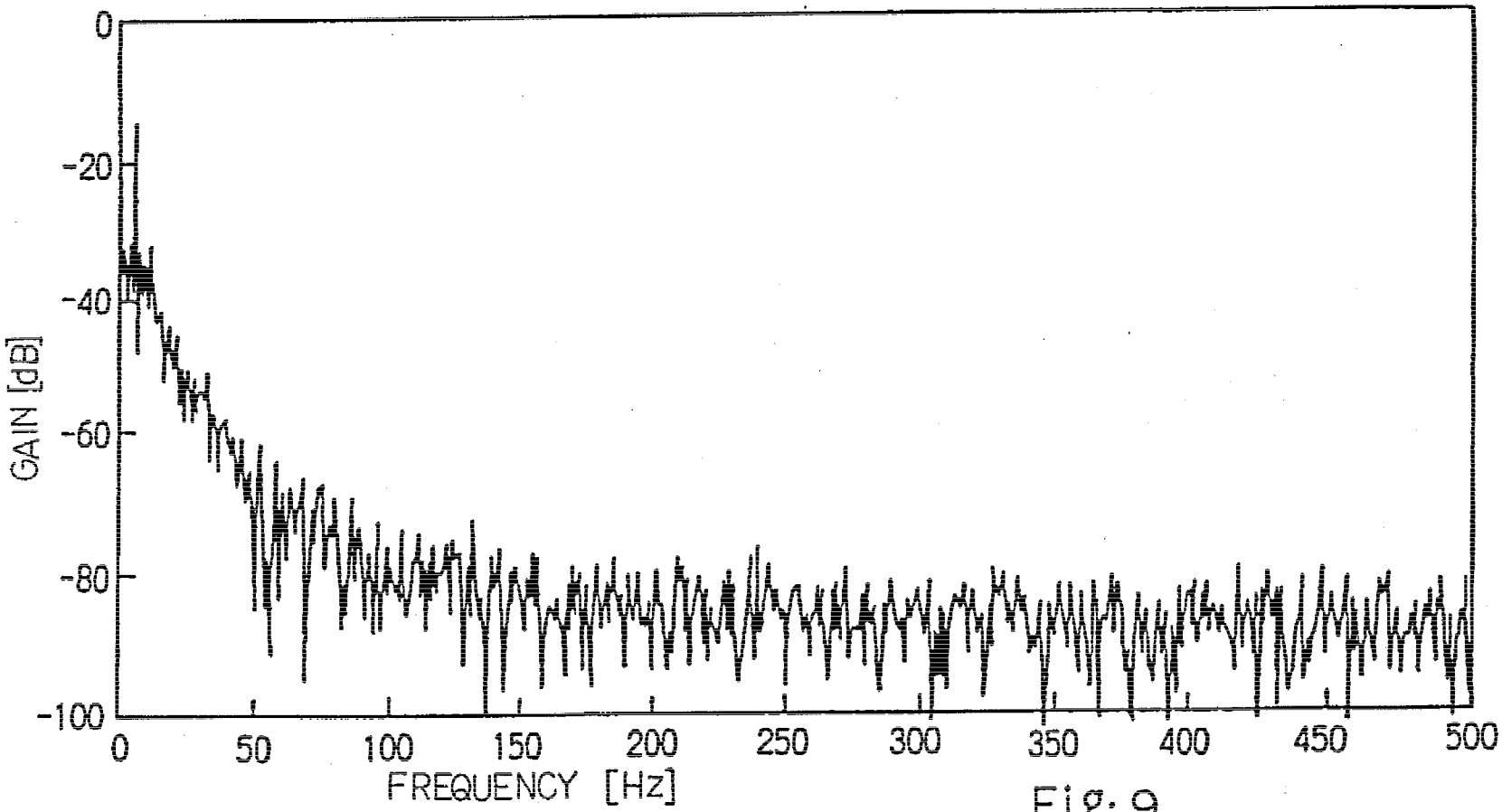
FIG. 9 is a graph showing the frequency spectrum of a analog pedal position signal.

The Bessel type low pass filter has an operational amplifier OP1. The inverted input node (−) is connected through a resistor R1 to an output node OUT1 thereof, and a series of resistors R2 and R3 is connected between an input node IN1 of the filter 10*b* and the non-inverted node (+) of the operational amplifier OP1. The output node OUT1 is further connected through a capacitor C1 to a node between the resistors R2 and R3, and the non-inverted input node (+) is connected through a capacitor C2 to a ground line GND. The Bessel type low pass filter achieves frequency characteristics shown in FIG. 8. The analog pedal position signal S1 has the frequency spectrum shown in FIG. 9, and the first anti-aliasing filter 10*b* is effective against the electric noise contained in the analog pedal position signal AS1. Although the first anti-aliasing filter 10*b* is implemented by the second-order Bessel type low pass filter, any filter circuit such as, for example, a third-order Bessel type low pass filter is available in so far as the filter eliminates the electric noise contained in the analog pedal position signal AS1.

The recording system 10 further includes an analog-to-digital converter 10*c* connected to the first anti-aliasing filter 10*b*, a second anti-aliasing filter 10*d* connected to the analog-to-digital converter 10*c*, a decimation circuit 10*e* connected to a second anti-aliasing filter 10*d* and a floppy disk driver 10*f* connected to the decimation circuit 10*e*.

Figure 6:
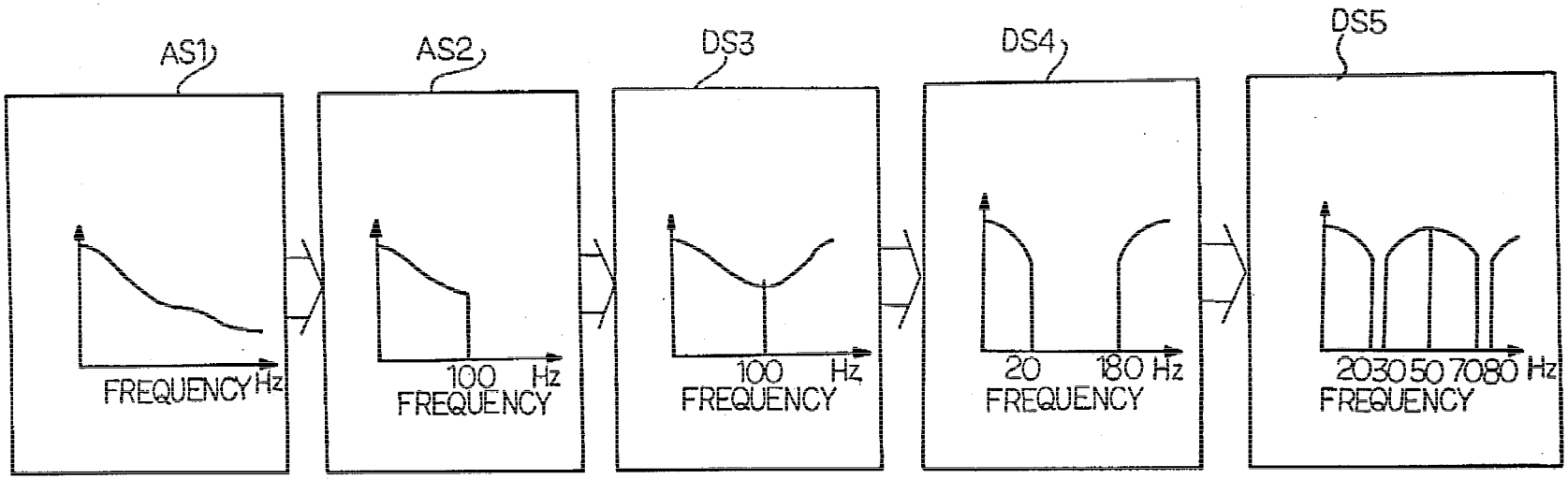
FIG. 6 is a flow chart showing variation of frequency spectrum through the recording system.

The analog pedal position signal AS2 is converted to a digital pedal position signal DS3, and the digital pedal position signal DS3 has a frequency spectrum labeled with "DS3" in FIG. 6. In this instance, the analog-to-digital converter 10*c* samples the analog pedal position signal AS2 at 200 Hz, and converts discrete potential levels to the digital pedal position signals DS3.

The digital pedal position signal DS3 is supplied to the second anti-aliasing filter 10*d*, and the second anti-aliasing filter 10*d* eliminates frequency components higher than the Nyquist frequency due to mechanical noises from the digital pedal position signal DS3. The mechanical noises means undesirable influences on the behavior of the damper pedal 13*a*, and mechanical vibrations propagated from a sound board and from a motor unit through the floor are typical examples of the undesirable influences. The cut-off frequency of the second anti-aliasing filter 10*d* is adjusted to 20 Hz so as to eliminate frequency components equal to or higher than the Nyquist frequency.

Figure 11:
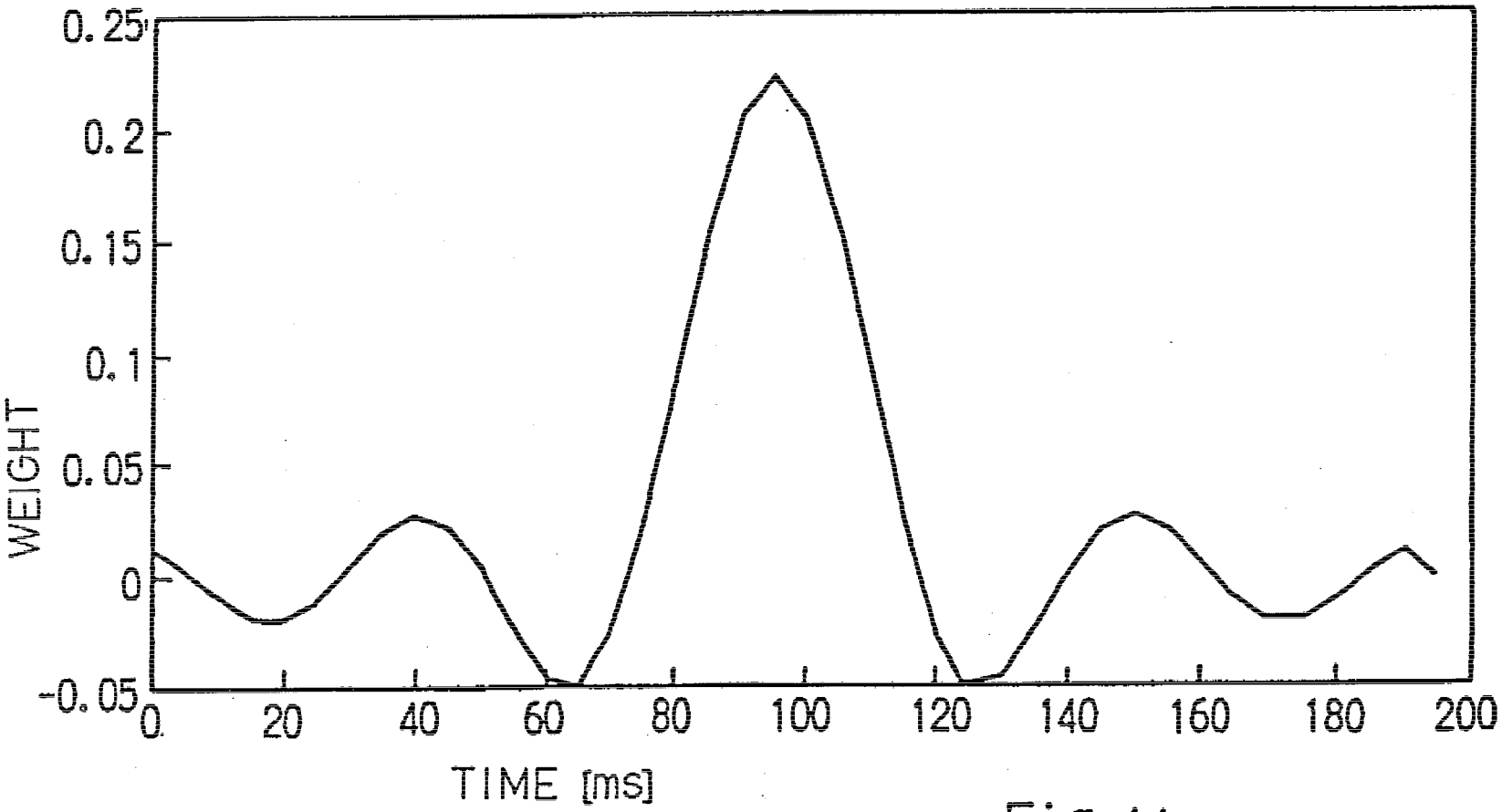
FIG. 11 is a graph showing an impulse response characteristics of the second anti-aliasing filter.
Figure 12:
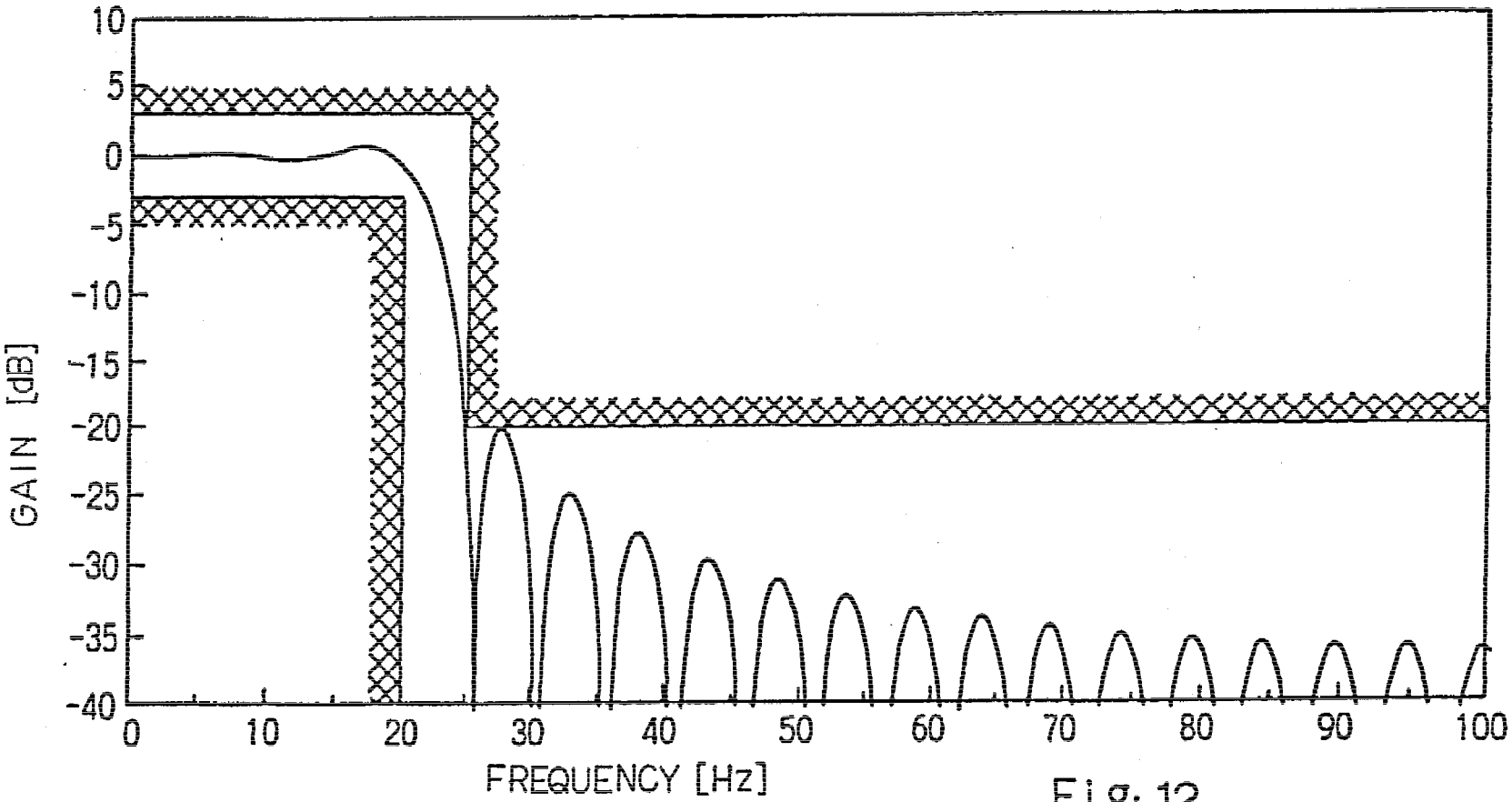
FIG. 12 is a graph showing frequency characteristics of the second anti-aliasing filter.
Figure 10:
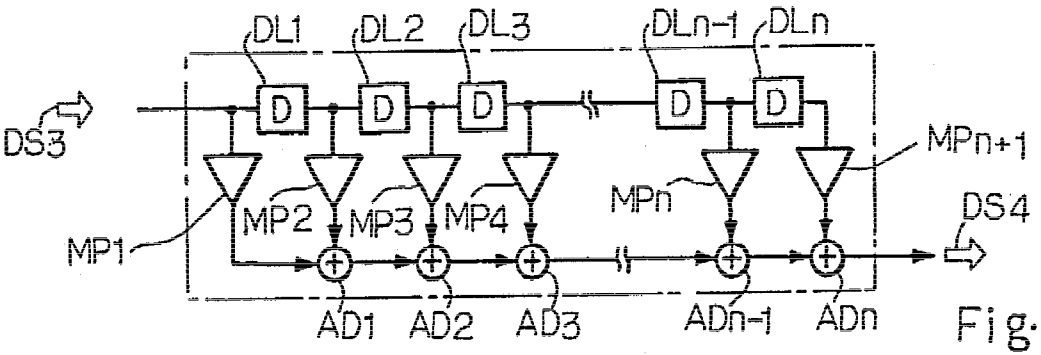
FIG. 10 is a circuit diagram showing the circuit configuration of a second anti-aliasing filter.

FIG. 10 illustrates the circuit configuration of the second anti-aliasing filter 10*d*. The second anti-aliasing filter 10*d* is an FIR filter adopted to eliminate frequency components equal to or greater than 20 Hz, and comprises delay elements DL1, DL2, DL3, . . . DLn−1 and DLn, multipliers MP1, MP2, MP3, MP4, . . . , MPn and MPn+1 and adders AD1, AD2, AD3, . . . ADn−1 and ADn. The function of the FIR filter is known to a skilled person, and no further description is incorporated hereinbelow. The impulse response characteristics of the FIR filter and the frequency characteristics are shown in FIGS. 10 and 11, respectively.

The second anti-aliasing filter 10*d* supplies a digital pedal position signal DS4 to a decimation circuit 10*e*, and the digital pedal position signal DS4 has a frequency spectrum DS4 shown in FIG. 6. The frequency components due to the mechanical noises have been eliminated from the digital pedal position signal DS4, and the digital pedal position signal DS4 exactly represent the motion of the damper pedal 13*a*.

Figure 13:
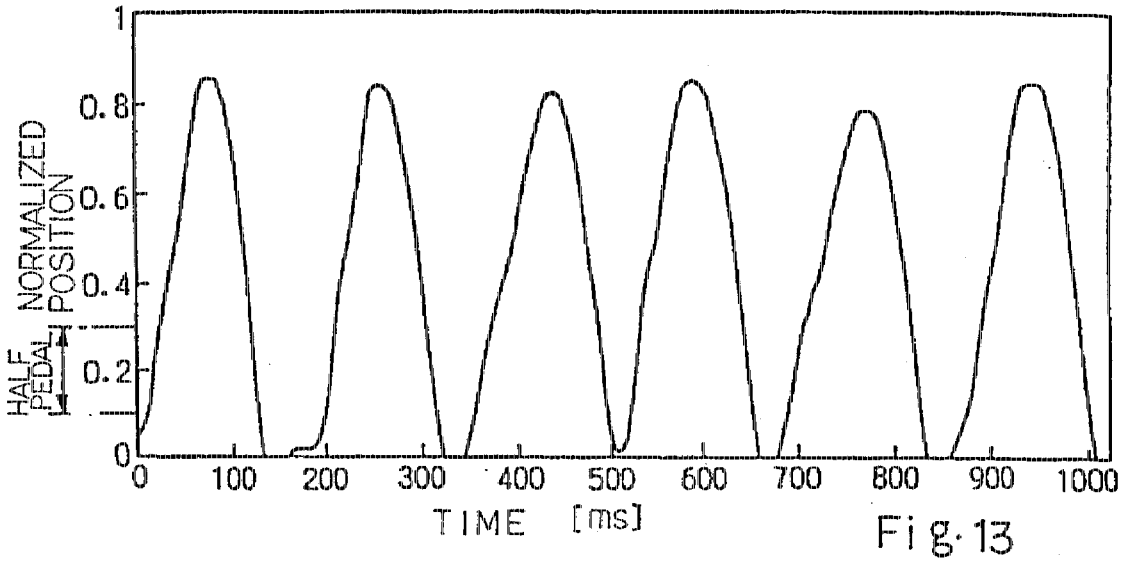
FIG. 13 is a graph showing a normalized position of a lifting rail in terms of time.
Figure 14:
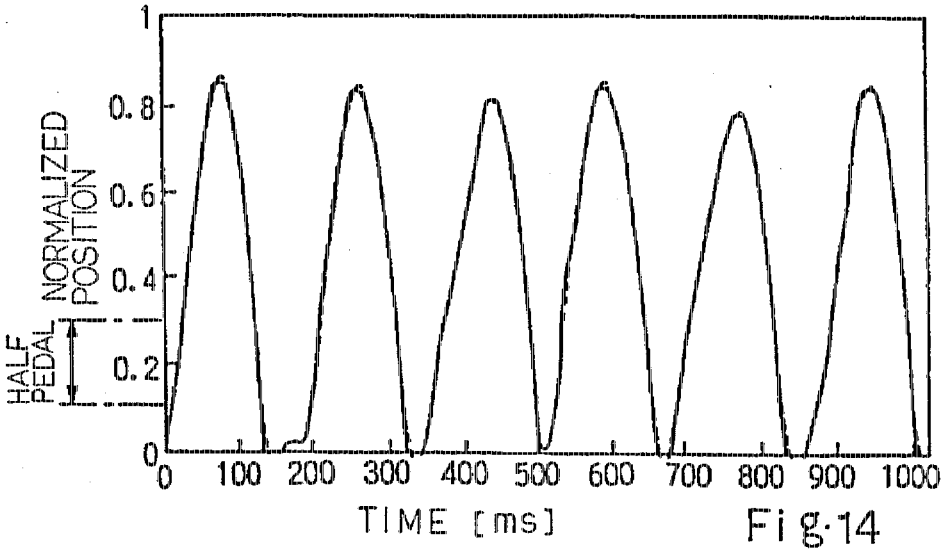
FIG. 14 is a graph showing the normalized position represented by an analog pedal position signal and the normalized position represented by a digital pedal position signal after an elimination of frequency components over 20 Hz.

The present inventor confirmed that, even through the frequency components equal to or greater than 20 Hz had between eliminated from the digital pedal position signal DS3, the digital pedal position signal DS4 exactly represented the motion of the damper pedal 13*a*. In detail, the present inventor repeated the downward/upward motion of the damper pedal 13*a*, and measured the actual position of the lifting rail 13*f*. The present inventor normalized the actual position, and plotted the normalized position in FIG. 13. The analog pedal position signal AS1 represented the normalized position of the lifting rail 13*f*. Subsequently, the present inventor plotted the normalized position represented by the analog pedal position signal AS1 in FIG. 14, again, and the normalized position represented by the digital pedal position signal DS4 was also plotted in FIG. 11. Although real line and broken line represented the analog pedal position signal AS1 and the digital pedal position signal DS4, respectively, they were almost overlapped with one another as shown in FIG. 14, and were slightly deviated around the peaks and small amplitude of the waveform. Especially, while the damper pedal 13*a* was being moved in the half pedal range from 0.1 to 0.3, the digital pedal position signal DS4 is perfectly overlapped with the analog pedal position signal AS1, it was confirmed that the elimination of the frequency components equal to or greater than 20 Hz did not affect the normalized position of the lifting rail 13*f* and a reproduction of half pedal.

The cut-off frequency of the first anti-aliasing filter 10*b* is 100 Hz which is a half of the sampling frequency of the second anti-aliasing filter 10*d*. Thus, when the cut-off frequency of the first anti-A filter 10*b* is determined, the Nyquist frequency is taken into account through the sampling frequency of the second anti-aliasing filter 10*d*.

The second anti-aliasing filter 10*d* sequentially supplies a series of digital pedal position signals DS5 to the decimation circuit 10*e*, and the frequency spectrum of the digital pedal position signal DS5 is labeled with "DS5" in FIG. 6.

The decimation circuit 10*e* decreases the digital pedal position signals DS5 to a fourth. In other words, when four digital pedal position signals DS5 are successively supplied from the second anti-aliasing filter 10*d* to the decimation circuit 10*e*, the decimation circuit 10*e* transfers every fourth digital pedal position signal DS5 to the floppy disk driver 10*f*, and ignores the other three digital pedal position signals DS5. The floppy disk driver 10*f* writes a piece of music data information represented by every fourth digital pedal position signal DS5 into a floppy disk 10*g*.

Turning to FIG. 4 of the drawings, the playback system 12 includes the solenoid-operated pedal actuator 11*a* connected between the damper pedal 13*b* and the lever 13*c*, an interpolation circuit 11*b* connected to the floppy disk driver 10*f*, a smoothing filter 11*c* connected to the interpolation circuit 11*a* and a driver 11*d* for the solenoid-operated pedal actuator 11*a*. The floppy disk driver 10*f* reads out the pieces of music data information from the floppy disk 10*g*, and restores a series of digital pedal position signals DS5. The series of digital pedal position signals DS5 are supplied to the interpolation circuit 11*b*.

The interpolation circuit 11*b* supplements nine dummy pedal position signals or zero data between every two digital pedal position signals DS5, and increases digital pedal position signals DS6 ten times larger in number than the digital pedal position signal DS5. Thus, the interpolation circuit 11*b* achieves an over-sampling for a feedback operation described hereinbelow. The digital pedal position signals DS6 has a frequency spectrum labeled with "DS6" in FIG. 15.

Figure 15:
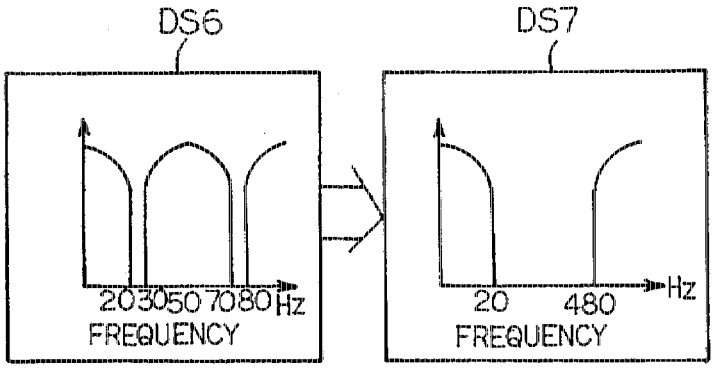
FIG. 15 is a flow chart showing a variation of frequency spectrum achieved by the playback system 12.

The digital pedal position signal DS6 is supplied to the smoothing filter 11*c*, and the smoothing filter 11*c* eliminates frequency components equal to or greater than 20 Hz from each of the digital pedal position signal DS6. As a result, the frequency spectrum is changed from "DS6" to "DS7" as shown in FIG. 15. As will be understood from comparison between the frequency spectrum DS4 and the frequency spectrum DS7, the digital pedal position signal DS7 is corresponding to the digital pedal position signal DS4, and a series of the digital pedal position signal DS4 well represents the original pedal motion.

Figure 16:
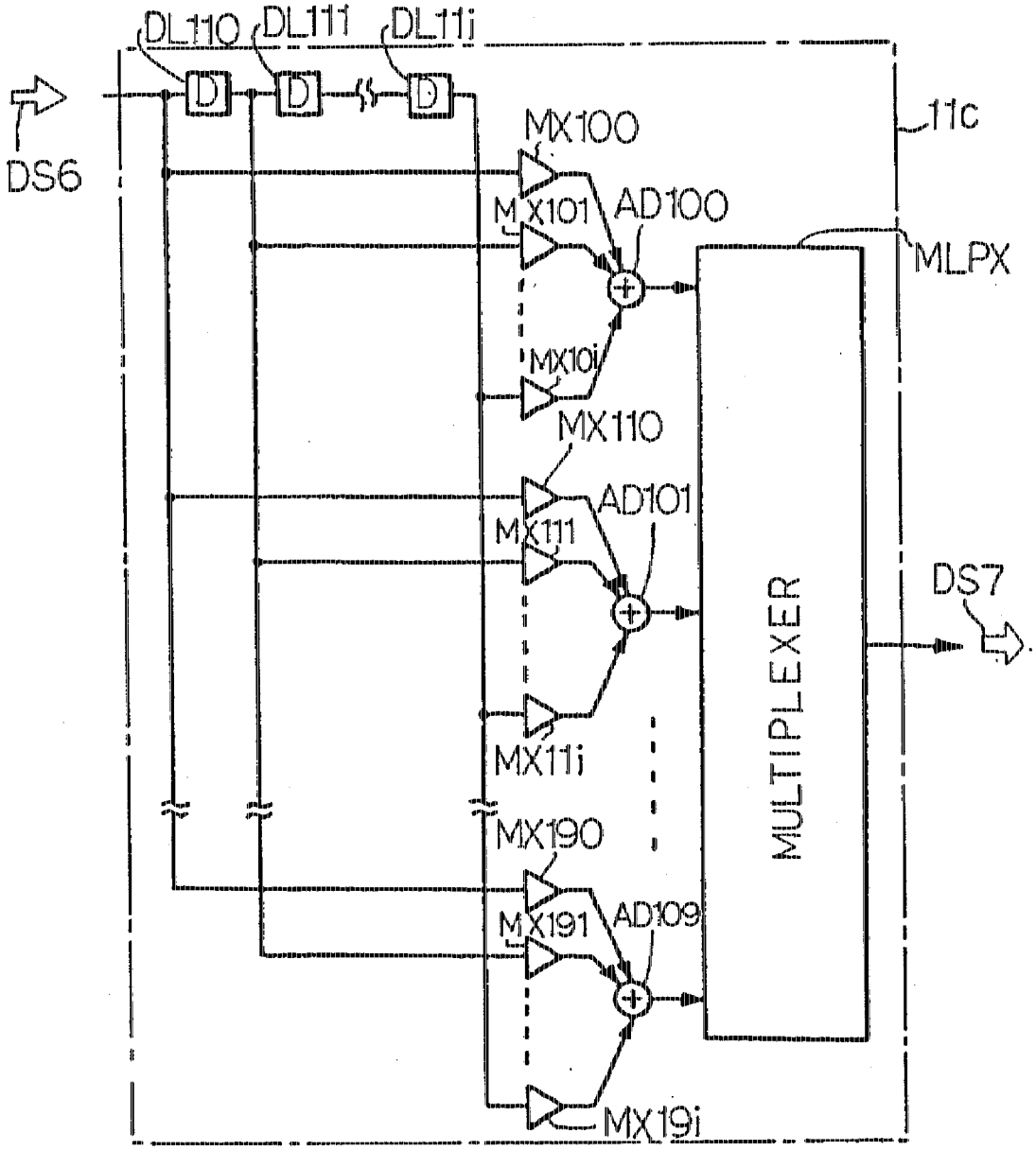
FIG. 16 is a circuit diagram showing the circuit configuration of a smoothing filter incorporated in the playback system.

FIG. 16 illustrates the circuit configuration of the smoothing filter 11*c*, and comprises delay elements DL110, DL111, . . . and DL11*i*, ten multiplier arrays MX100–MX10*i*, MX110–MX11*i*, . . . and MX190–MX19*i* selectively connected to the delay elements DL110–DL11*i*, ten adders AD100–AD109 and a multiplexer MLPX connected to the ten adders AD100–AD109. The multiplexer MLPX selectively transfers the data signals from the adders AD100–AD109 to the driver 11*d*, and smoothes the digital pedal position signals DS6 at 500 Hz.

The smoothing filter 11*c* supplies a series of digital pedal position signals DS7 to the driver 11*d*, and each of the digital pedal position signals DS7 is indicative of a target pedal position of the damper pedal 13*a*. The analog pedal position signal AS1 is supplied to the driver 11*d*, and the driver 11*d* changes the potential level of a driving current signal DR in such a manner as to decrease the difference between the actual pedal position represented by the analog pedal position signal AD1 and the target position represented by the digital pedal position signal DS7 to zero, and supplies the driving current signal DR to the solenoid-operated actuator unit 11*a*. The solenoid-operated pedal actuator unit 11*a* projects the plunger by a length proportional to the potential level of the driving current signal DR, and controls the damper pedal 13*a* so as to trace the trajectory during the original performance.

The feedback control requires a sampling frequency around 500 Hz of the digital pedal position signal DS7, and the interpolation circuit 11*b* carries out the over-sampling.

Description is made on a behavior of the pedal controller 12 according to the present invention. A player manipulated the damper pedal 13*a* during a performance, and the pedal motion was transferred through the solenoid-operated pedal actuator 11*a* to the lever 13*c* and further through the rod 13*e* to the lifting rail 13*f*. The analog position sensor 10*a* changed the potential level of the analog pedal position signal AS1 depending upon the position of the lifting lever 13*f*, and the analog pedal position signal AS1 was supplied to the first anti-aliasing filter 10*b*.

The first anti-aliasing filter 10*b* changed the analog pedal position signal AS1 to the analog pedal position signal AS2, and the analog-to-digital converter 10*c* sampled the analog pedal position signal AS2 at 200 Hz. The analog-to-digital converter 10*c* converted the discrete potential levels to the digital pedal position signals DS3.

Figure 17:
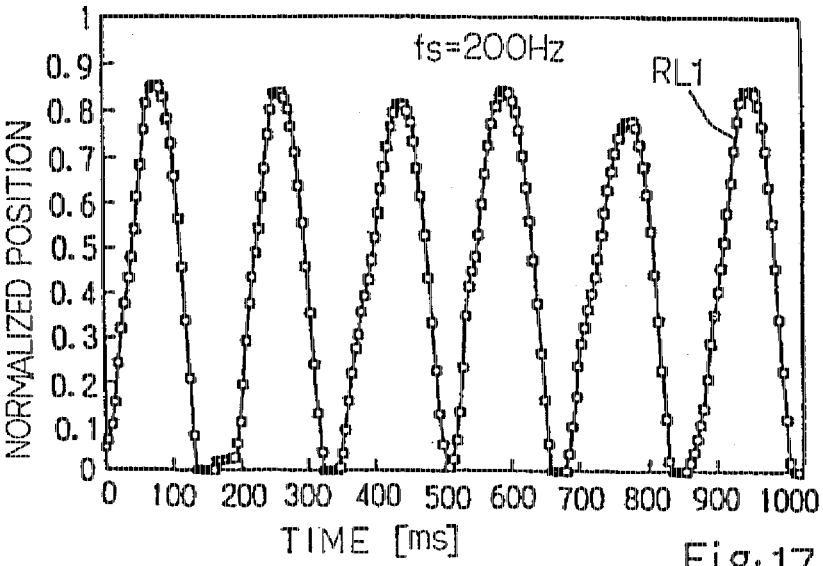
FIG. 17 is a graph showing a variation of normalized position represented by an analog pedal position signal and discrete normalized positions represented by digital pedal position signals after an analog-to-digital conversion.

The present inventor plotted the waveform of the analog pedal position signal AS1 in FIG. 17, and the normalized position represented by the analog pedal position signal AS1 traced along real line RL1. The present inventor calculated normalized positions on the basis of a series of digital pedal position signals DS3 sampled at 200 Hz, and the normalized positions were also plotted in FIG. 17. The discrete normalized positions were represented by small squares. The discrete normalized positions were plotted on the real line RL1, and were well matched with the continuous normalized position represented by the analog pedal position signal AS1.

Figure 18:
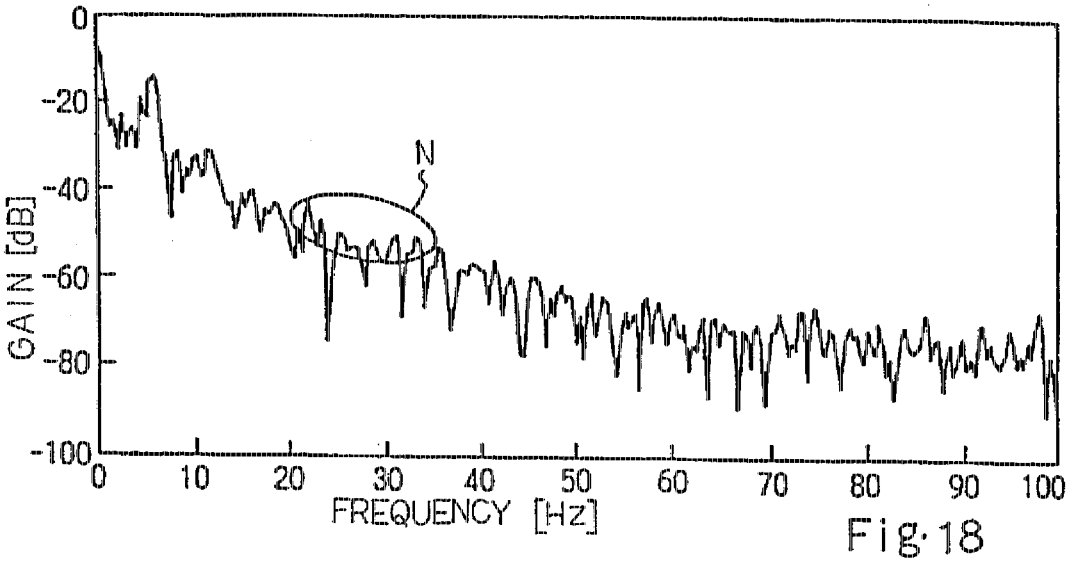
FIG. 18 is a graph showing a frequency spectrum of the digital position signals after the analog-to-digital conversion.

The present inventor further measured a frequency spectrum of the digital pedal position signal DS3, and plotted the frequency spectrum in FIG. 18. Most of the frequency components equal to or greater than 20 Hz were caused by the mechanical noises, and the gain in a frequency range N was too large. The gain in the frequency range N had to be decreased.

Figure 19:
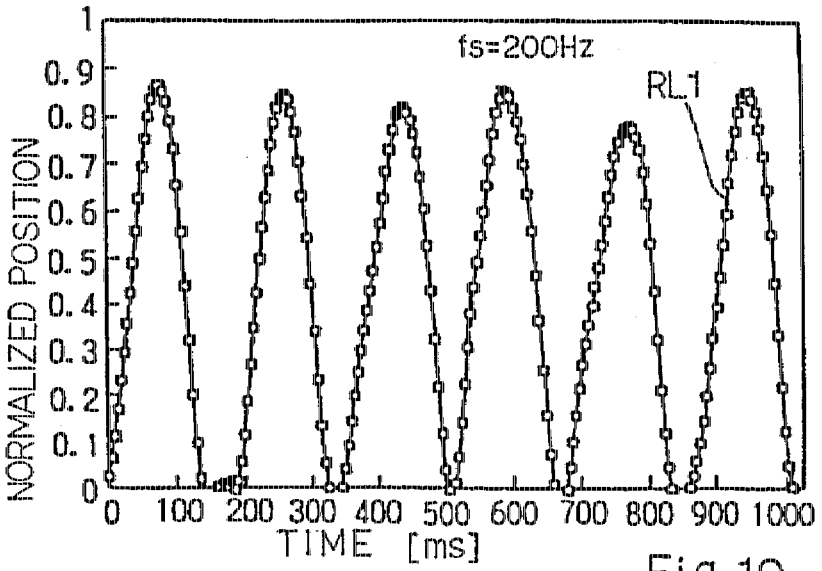
FIG. 19 is a graph showing the variation of normalized position and discrete normalized positions represented by digital pedal position signals after an anti-aliasing operation.
Figure 20:
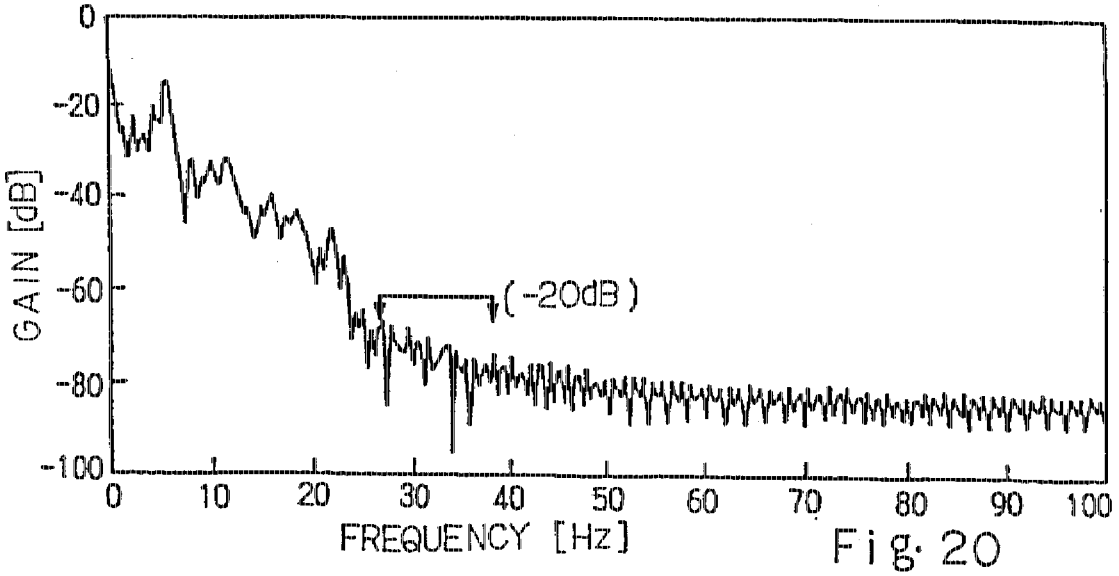
FIG. 20 is a graph showing a frequency spectrum of the digital pedal position signals after the anti-aliasing operation.

The digital pedal position signals DS3 were supplied to the second anti-aliasing filter 10*d*, and the second anti-aliasing filter 10*d* eliminated the frequency components due to the mechanical noises. The present inventor calculated discrete normalized positions on the basis of the digital pedal position signals DS4, and plotted in FIG. 19. The real line RL1 represented the continuous normalized position represented by the analog pedal position signal AS1. The discrete normalized positions were exactly plotted on the real line RL1 as similar to the discrete normalized positions calculated from the digital pedal position signals DS3. However, the frequency spectrum was surely improved. FIG. 20 illustrated the frequency spectrum of the digital pedal position signals DS4, and the gain in the frequency range N was decreased by 20 dB.

Figure 21:
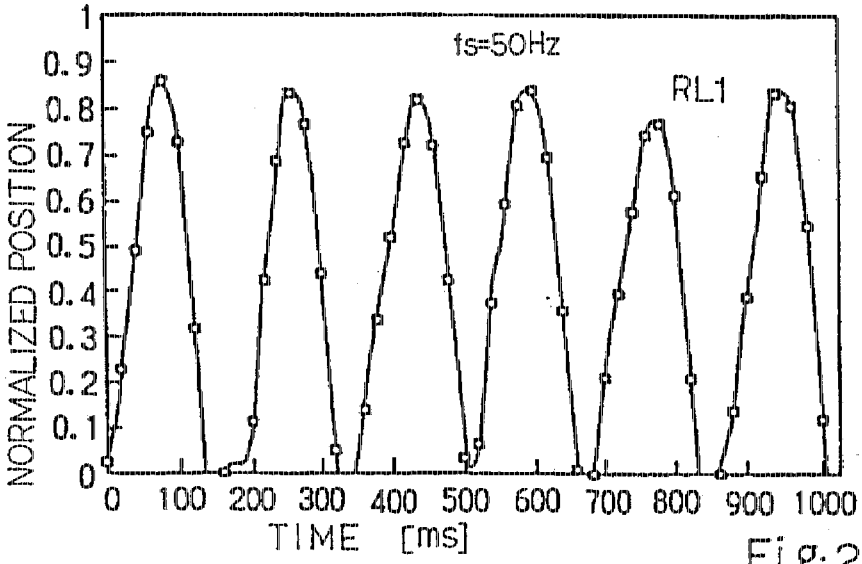
FIG. 21 is a graph showing discrete normalized positions represented by digital pedal position signals after a decimation.

The digital pedal position signals DS4 were successively supplied to the decimation circuit 10*e*, and were decreased to a fourth. The decimation was equivalent to a sampling at 50 Hz. The present inventor calculated discrete normalized position on the basis of the digital pedal position signal DS5, and plotted the discrete normalized positions in FIG. 21. The continuous normalized position was also represented by the real line RL. The discrete normalized positions were on the real line, and the relatively small number of digital pedal position signals DS5 well represented the pedal motion.

Thus, the decimation circuit 10*e* effectively decreased the amount of musical data information to be stored in the floppy disk without sacrifice of the accuracy.

Figure 22:
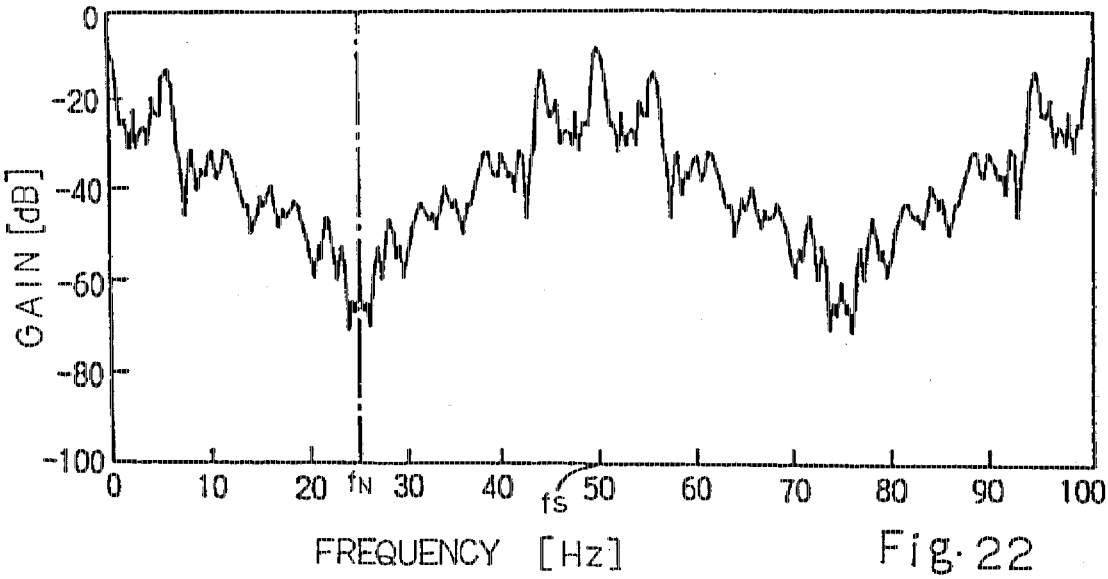
FIG. 22 is a graph showing a frequency spectrum of the digital pedal position signals after the decimation.

The present inventor measured the frequency spectrum of the digital pedal position signals DS5, and plotted in FIG. 22. Aliasing noise took place with respect to the Nyquist frequency $f_N$.

Thus, the electric and mechanical noises were eliminated from the digital pedal position signals DS4, and the digital pedal position signals DS4 were decimated to the digital pedal position signals DS5. The pieces of music data information of the digital pedal position signals DS5 were written into the floppy disk 10*g*.

Subsequently, the pieces of music data information were read out from the floppy disk 10*g*, and the floppy disk driver 10*f* restored the digital pedal position signals DS5. The interpolation circuit 11*b* supplemented the dummy data codes, and produced the digital pedal position signals DS6. The digital pedal position signals DS6 were equivalent to digital position signals sampled at 500 Hz.

Figure 23:
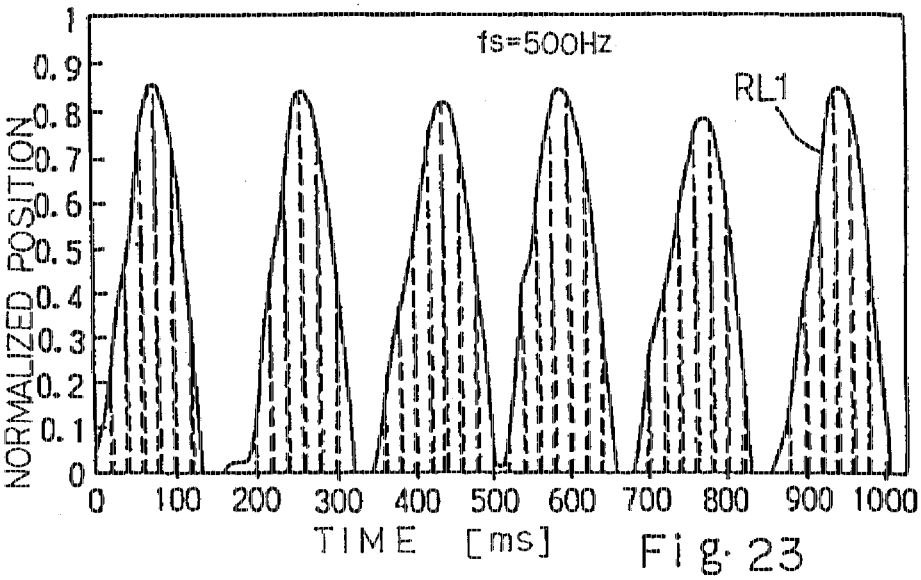
FIG. 23 is a graph showing discrete normalized positions represented by digital pedal position signals restored from music data information read out from a floppy disk after an interpolation.

The present inventor calculated discrete normalized positions represented by the digital pedal position signals DS6, and plotted in FIG. 23. Broken lines were indicative of the discrete normalized positions, and the continuous normalized position was represented by the real line RL1. The discrete normalized positions were well matched with the continuous normalized position, and the present inventor confirmed that the digital pedal position signals DS6 were available for the reproduction of the pedal motion.

Figure 24:
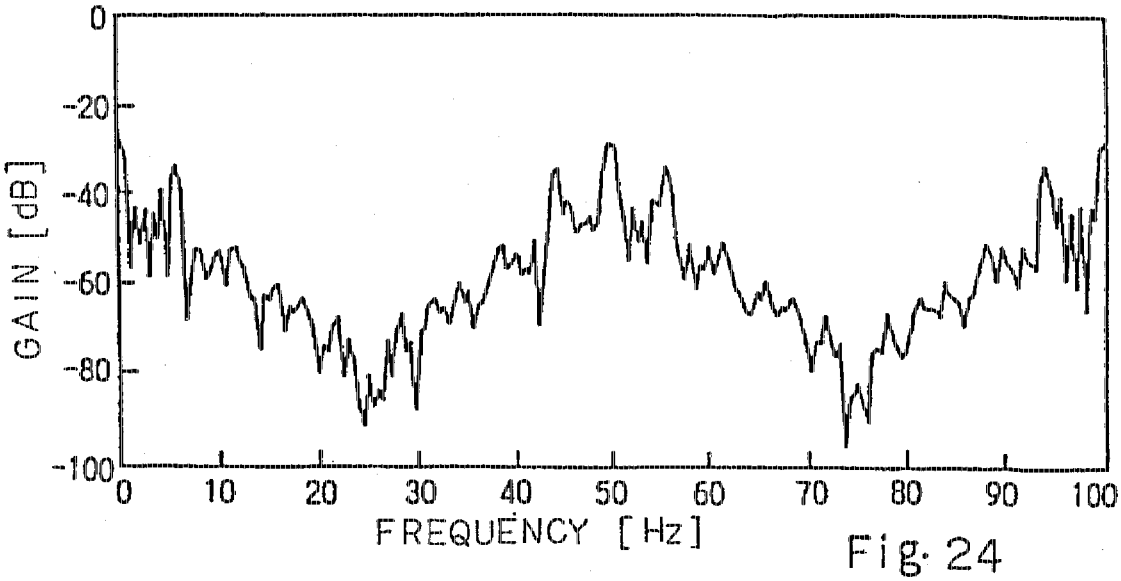
FIG. 24 is a graph showing a frequency spectrum of the digital pedal position signals after the interpolation.

The present inventor further measured a frequency spectrum of the digital pedal position signals DS6, and plotted the frequency spectrum in FIG. 24.

Figure 25:
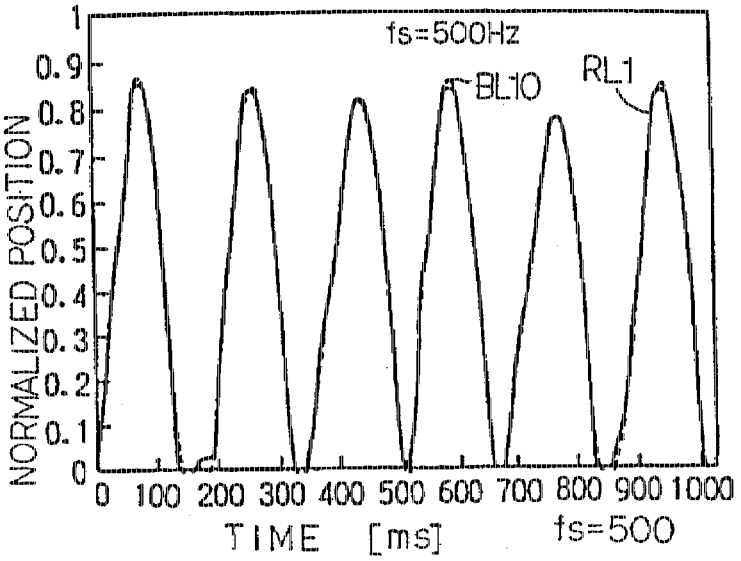
FIG. 25 is a graph showing discrete normalized positions represented by digital pedal position signals after smoothing.
Figure 26:
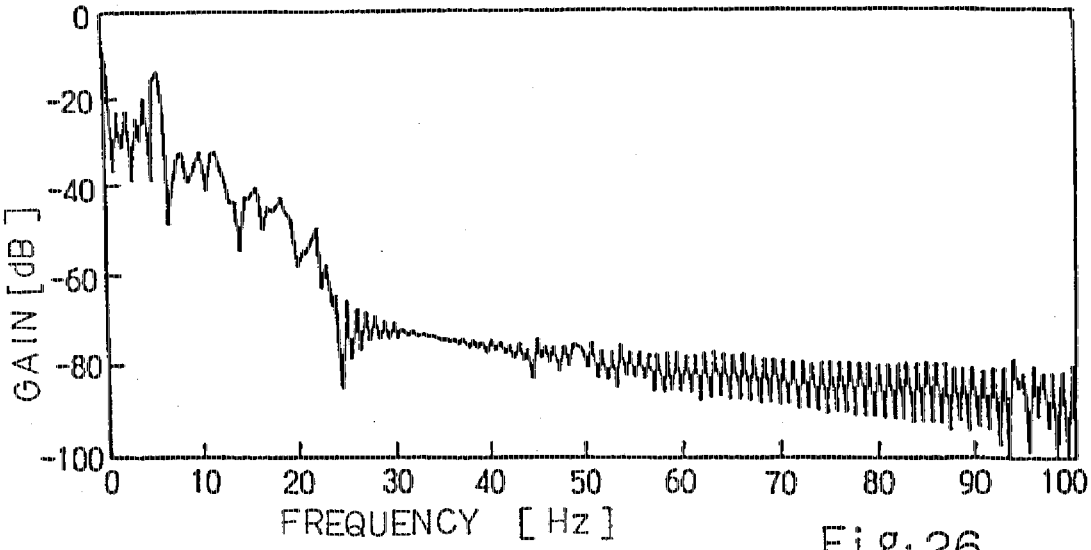
FIG. 26 is a graph showing a frequency spectrum of the digital pedal position signals after the smoothing.

The digital pedal position signals DS6 were supplied to the smoothing filter 11*c*, and frequency components equal to or greater than 20 Hz were eliminated from the digital pedal position signals DS6. The present inventor calculated the discrete normalized positions represented by the digital pedal position signals DS7, and plotted the discrete normalized positions in FIG. 25. The present inventor connected the discrete normalized positions through broken line BL10, and most of the broken lines BL10 was overlapped with the real line RL1. The present inventor further measured a frequency spectrum of the digital pedal position signals DS7, and plotted them in FIG. 26.

As will be understood from the foregoing description, although the digital pedal position signals are decimated before storing the pieces of music data information into the floppy disk 10*g* and interpolated after reading out them, the digital pedal position signals DS7 exactly represent the original pedal motion, and the damper pedal 13*a* traces the trajectory recorded in the original performance.

In the first embodiment, the analog position sensor 10*a*, the first anti-aliasing filter 10*b* and the analog-to-digital converter 10*c* form in combination a pedal position monitoring means, the second anti-aliasing filter 10*d* serves as a noise eliminating means, the decimating circuit 10*e* serves as a decimating means, the floppy disk driver 10*f* serves as a recording means, the interpolating circuit 11*b* serves as an interpolation means, the smoothing circuit 11*c* serves as a smoothing means, and the driver 11*d* and the solenoid-operated pedal actuator 11*a* as a whole constitute an actuator means.

Second Embodiment

Figure 27:
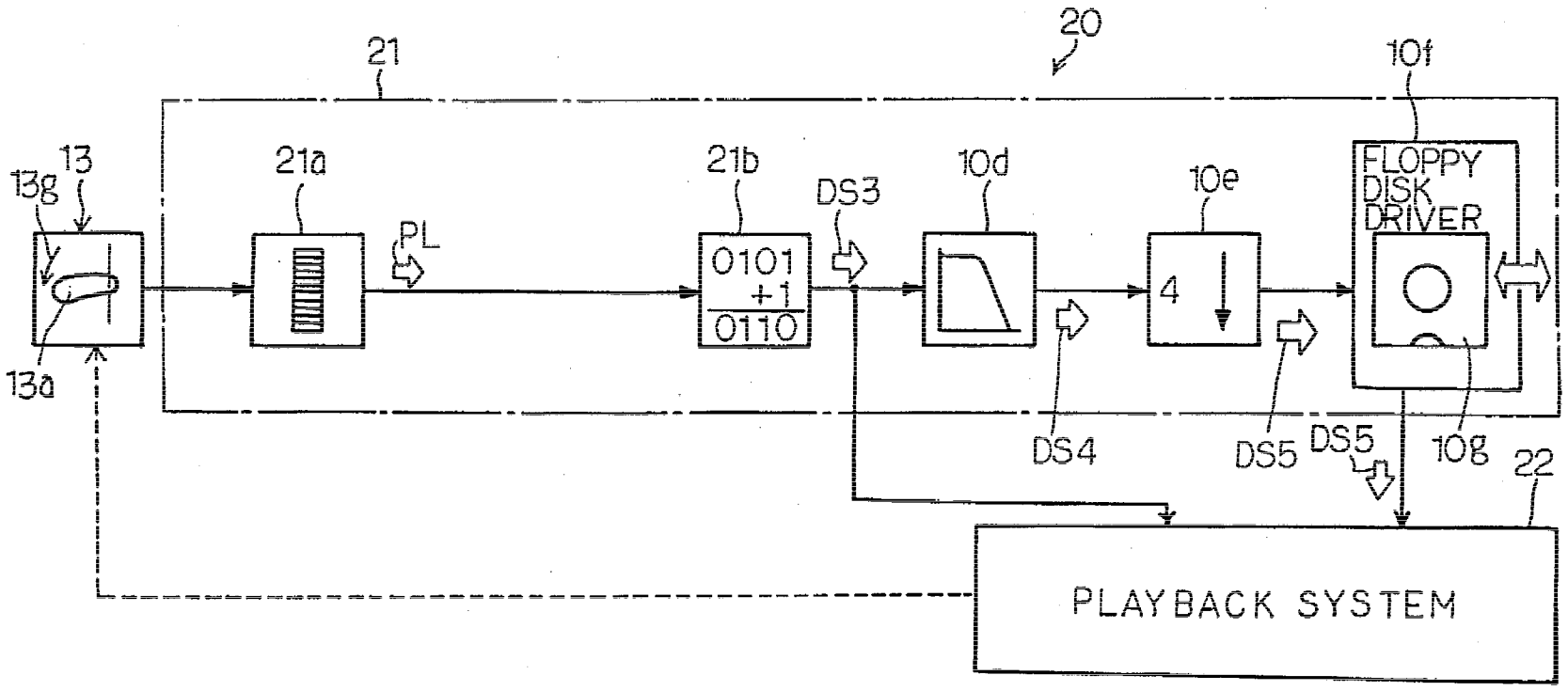
FIG. 27 is a block diagram showing a recording system of another pedal controller according to the present invention.

Turning to FIG. 27 of the drawings, another pedal controller 20 largely comprises a recording system 21 and a playback system 22. The playback system 22 is analogous to the playback system 12, and is not described hereinbelow for avoiding repetition.

The analog position sensor 10*a* and the combination of the first anti-aliasing filter 10*b* are replaced with a digital position sensor 21*a* and an up-and-down counter 21*b*, respectively. An encoder is available for the digital position sensor 21*b*, and the digital position sensor 21*b* is free from the electric noises. For this reason, the first anti-aliasing filter 10*b* is not incorporated in the recording system 21. The up-and-down counter 21b is incremented and decremented with a pulse signal PL, and outputs the digital pedal position signal DS3. The up-and-down counter 21b periodically outputs a digital pedal position signal representative of a current pedal position, and the inverse of a period between the two digital pedal position signals is corresponding to the sampling frequency of the analog-to-digital converter 10c. The up-and-down counter 21b supplies the digital pedal position signals DS3 to the anti-aliasing filter 10d at 200 Hz, and the decimation circuit 10e decreases the frequency to 50 Hz.

The other components of the recording system 21 are similar to those of the recording system 10, and the circuit behavior is analogous to that of the recording system 10. For this reason, no further description is incorporated hereinbelow.

The pedal controller 20 also includes the decimation circuit 10e and the interpolation circuit, and the decimation circuit 10e and the interpolation circuit decrease the pieces of music data information stored in a floppy disk 10g.

In the second embodiment, the digital pedal sensor 21a and the up-and-down counter 21b as a whole constitute a pedal position monitoring means.

As will be appreciated from the foregoing description, the pedal controller according to the present invention decimates the digital pedal position signals before storing the pieces of music data information represented by the digital pedal position signals, and interpolates dummy data after reading out the pieces of music data information. As a result, the amount of data to be stored is drastically decreased. Moreover, the pedal controller according to the present invention eliminates the electric/mechanical noises from the data, and the pieces of music data information exactly represent the pedal motion in an original performance in spite of the reduction of the amount of data.

Although particular embodiments of the present invention have been shown and described, it will be obvious to those skilled in the art that various changes and modifications may be made without departing from the spirit and scope of the present invention.

For example, the analog position sensor may be implemented by a variable resistor having a slider connected to the pedal 13b, the lever 13c or 13f or the rod 13e. Any analog position sensor is available for the pedal mechanism.

In the above embodiments, cut-off frequency is selected to 20 Hz. The cut-off frequency is dependent on the pedal motion, and the cut-off frequency at 20 Hz is appropriate for the damper pedal. However, the cut-off frequency for another pedal may be different depending upon a standard pedal motion to be reproduced. The cut-off frequency for another pedal may be changed to 25 Hz, 30 Hz or other value.

The sampling frequency fs for the analog-to-digital converter 10a or the frequency of the data output from the up-and-down counter 21a may range from 80 to 500 Hz. Especially, when the pedal controller according to the present invention is provided for a soft pedal, the sampling frequency or the frequency of the data output may be adjusted to 80 Hz, because the frequency spectrum of the pedal position signals is narrower than that for the damper pedal.

The decimation circuit 10e may repeat the function as if the digital pedal position signals are sampled at 20 Hz and 125 Hz. The interpolation circuit 11b may interpolate dummy data so as to generate the digital pedal position signal DS6 corresponding to the sampling frequency ranging from 80 Hz to 500 Hz. In other words, the interpolation circuit 11b outputs the digital pedal position signals at least four times larger than the digital pedal position signals supplied thereto.

Figure 28:
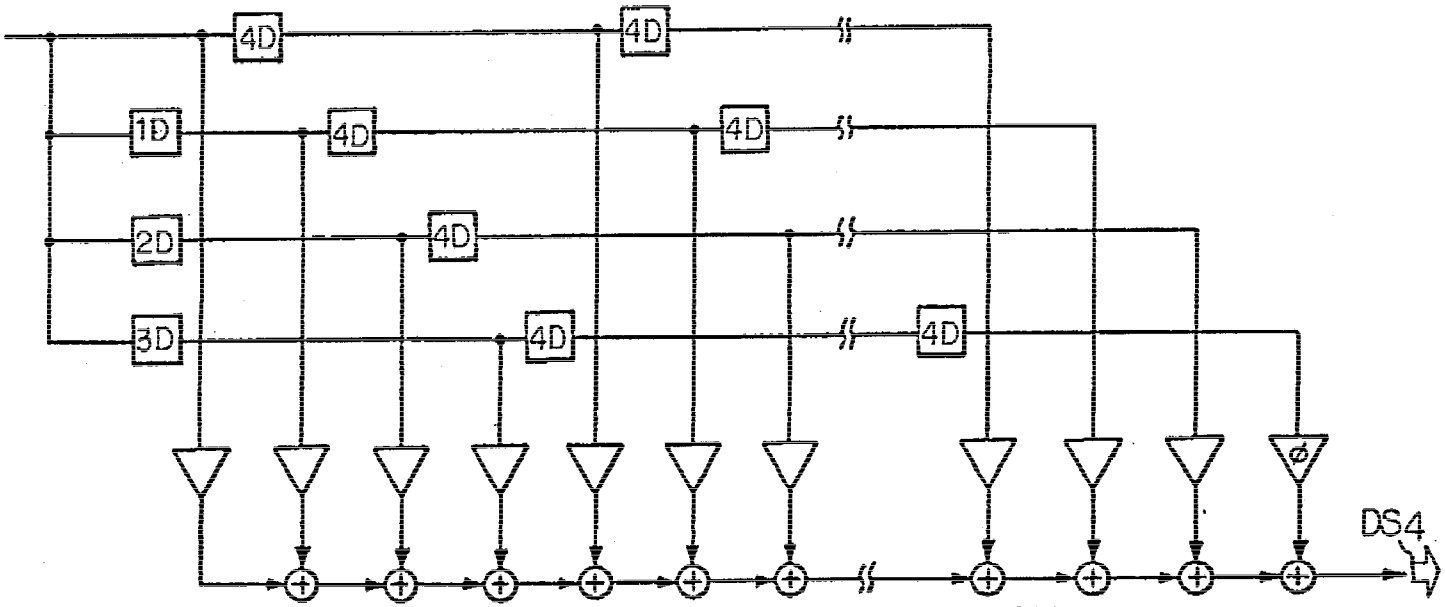
FIG. 28 is a circuit diagram showing the configuration of another second anti-aliasing filter.

Finally, the second anti-aliasing filter 10d shown in FIG. 10 may be replaced with another circuit configuration shown in FIG. 28.

The anti-aliasing filter shown in FIG. 28 carries out the filtering operation fop every fourth digital pedal position signal, because the other three digital pedal position signals are ignored by the decimation circuit 10e.

The anti-aliasing filter shown in FIG. 28 comprises delay elements 1D, 2D, 3D and 4D, multipliers represented by small triangles and adders represented by mark (+), and the numerals "1", "2", "3" and "4" labeled with "D" are representative of delay times, respectively. The anti-aliasing filter shown in FIG. 28 break up the load by a quarter for calculating the digital pedal position signal DS4.

What is claimed is:

1. A pedal controller for recording and reproducing a motion of a pedal, comprising:

a recording system including a pedal position monitoring means for periodically generating first pedal position signals representative of said motion at a first frequency, an noise eliminating means for eliminating frequency components due to a noise from said first pedal position signals, a decimating means for selecting second pedal position signals from said first pedal position signals, and a recording means for storing pieces of data information represented by said second pedal position signals into a recording medium; and a playback system including an interpolation means for interpolating dummy data signals into third pedal position signals restored from said pieces of data information, said dummy data signals and said third pedal position signals forming fourth pedal position signals periodically output therefrom at a second frequency larger in value than said first frequency, a smoothing means smoothing said fourth pedal position signals for generating fifth pedal position signals, and an actuator means responsive to said fifth pedal position signals for reproducing said motion of said pedal.

2. The pedal controller as set forth in claim 1, in which said pedal is one of a damper pedal and a soft pedal incorporated in an acoustic piano.

3. The pedal controller as set forth in claim 2, in which said pedal position monitoring means has an analog position sensor for generating a first analog pedal position signal representative of said motion of said one of said damper pedal and said soft pedal, another anti-aliasing filter connected to said analog position sensor and eliminating frequency components equal to or greater than a first predetermined frequency so as to generate a second analog pedal position signal, and an analog-to-digital converter connected to said another anti-aliasing filter and periodically sampling said second analog pedal position signal at a second frequency so as to generate said first pedal position signals.

4. The pedal controller as set forth in claim 3, in which said second frequency ranges from 80 Hz to 500 Hz.

5. The pedal controller as set forth in claim 3, in which said pedal is said damper pedal, said first frequency and said second frequency is 20 Hz and 200 Hz.

6. The pedal controller as set forth in claim 3, in which said analog-to-digital converter outputs said first pedal position signals at said first frequency ranging from 80 Hz to 500 Hz, and the number of said second pedal position signals per a unit time is a quarter of the number of said first pedal position signals per said unit time.

7. The pedal controller as set forth in claim 3, in which said interpolation means outputs said fourth pedal position signals at least four times larger in number than said third pedal position signals.

8. The pedal controller as set forth in claim 1, in which said pedal position monitoring means has a digital pedal sensor generating a pulse signal when said pedal is moved by a unit length, and an up-and-down counter connected to said digital pedal sensor and responsive to said pulse signal for generating said first pedal position signals.

9. A method of controlling a pedal, comprising the steps of:

periodically generating first pedal position signals representative of a motion of said pedal at a first frequency, eliminating frequency components due to a noise from said first pedal position signals, decimating said first pedal position signals for generating second pedal position signals, recording pieces of data information represented by said second pedal position signals into a recording medium, interpolating dummy data signals into third pedal position signals restored from said pieces of data information so as to generating fourth pedal position signals at a second frequency larger in value than said first frequency, smoothing said fourth pedal position signals for generating fifth pedal position signals, and moving said pedal in response to said fifth pedal position signals for reproducing said motion.

* * * * *